US008127381B2

(12) United States Patent
Westmoreland, II et al.

(10) Patent No.: US 8,127,381 B2
(45) Date of Patent: Mar. 6, 2012

(54) COLLAPSIBLE LITTER APPARATUS, SYSTEM AND METHOD

(75) Inventors: Ted Carson Westmoreland, II, Greenville, SC (US); James R. Johnston, Jr., Pinehurst, NC (US)

(73) Assignee: Speer Operational Technologies, LLC, Greenville, SC (US)

( * ) Notice: Subject to any disclaimer, the term of this patent is extended or adjusted under 35 U.S.C. 154(b) by 286 days.

(21) Appl. No.: 12/635,321

(22) Filed: Dec. 10, 2009

(65) Prior Publication Data

US 2010/0138999 A1 Jun. 10, 2010

Related U.S. Application Data

(60) Provisional application No. 61/121,224, filed on Dec. 10, 2008.

(51) Int. Cl.
*A61G 1/013* (2006.01)

(52) U.S. Cl. ..... 5/627; 5/176.1; 5/202; 5/286

(58) Field of Classification Search ..... 5/110–112, 5/114–117, 174, 176.1, 177, 187, 200.1, 5/202, 286, 625–628
See application file for complete search history.

(56) References Cited

U.S. PATENT DOCUMENTS

| | | | | |
|---|---|---|---|---|
| 239,664 | A | | 4/1881 | Nash |
| 299,670 | A | | 6/1884 | Nash |
| 529,301 | A | | 11/1894 | Ortega |
| 688,185 | A | | 12/1901 | Stretcher |
| 2,156,507 | A | | 8/1937 | Means |
| 2,118,780 | A | | 5/1938 | Robinson |
| 2,396,931 | A | | 3/1946 | Schmid |
| 2,650,373 | A | * | 9/1953 | Zeller et al. ..... 5/627 |
| 2,671,229 | A | | 3/1954 | Vernier |
| 2,682,670 | A | | 7/1954 | Crump |
| 2,973,888 | A | | 3/1961 | Beardsley |
| 3,000,018 | A | | 9/1961 | Collins |
| 3,110,912 | A | | 11/1963 | Propst |
| 3,206,774 | A | | 9/1965 | Bertram |
| 3,223,300 | A | | 12/1965 | Moore et al. |
| 3,247,529 | A | | 4/1966 | Benton |
| 3,287,895 | A | | 11/1966 | Hire |
| 3,373,454 | A | | 3/1968 | Curtis |
| 3,417,412 | A | * | 12/1968 | Andrews ..... 5/627 |
| 3,426,367 | A | | 2/1969 | Bradford |
| 3,555,578 | A | * | 1/1971 | Pile ..... 5/627 |
| 3,601,824 | A | | 8/1971 | Bradford ..... 5/82 |
| 3,648,305 | A | | 3/1972 | Ersek ..... 5/82 |
| 3,663,972 | A | * | 5/1972 | Denton ..... 5/625 |
| 3,886,606 | A | | 6/1975 | Bradford ..... 5/82 |
| 4,480,345 | A | | 11/1984 | Dunn ..... 5/82 |
| 4,685,161 | A | | 8/1987 | Zalman ..... 5/82 |
| 4,871,101 | A | | 10/1989 | Bunz et al. ..... 224/153 |
| 5,301,377 | A | | 4/1994 | Kim ..... 5/110 |
| 5,327,600 | A | * | 7/1994 | Hoogendoorn ..... 5/625 |
| 5,598,592 | A | | 2/1997 | Castellani ..... 5/627 |

(Continued)

*Primary Examiner* — Michael Trettel
(74) *Attorney, Agent, or Firm* — Sara C. Kanos; Nexsen Pruet, LLC

(57) ABSTRACT

A collapsible litter carrier apparatus, system and method. Generally, the litter apparatus includes a frame assembly having a plurality of hingedly connected, longitudinally adjacent sections that are foldable or collapsible, accordion-like, into a compact arrangement when the carrier is not in use or being stored. Releaseably attached to the frame assembly is a body-supporting bed or sheet. Additionally, the frame assembly is provided with a plurality of foldable handles that are hingedly connected to the outer corners of the extended frame.

20 Claims, 10 Drawing Sheets

U.S. PATENT DOCUMENTS

| | | | | |
|---|---|---|---|---|
| 5,699,568 | A | 12/1997 | Couldridge | 5/628 |
| 6,461,290 | B1 | 10/2002 | Reichman et al. | 600/21 |
| 6,842,923 | B1 | 1/2005 | Castellani et al. | 5/627 |
| 6,907,632 | B2 * | 6/2005 | Bourgraf, Jr. | 5/627 |
| 7,022,094 | B2 | 4/2006 | Buckman et al. | 602/23 |
| 7,784,122 | B2 * | 8/2010 | Oh | 5/201 |
| 2005/0028283 | A1 | 2/2005 | Castellani et al. | 5/627 |
| 2005/0210589 | A1 * | 9/2005 | Dimentmen | 5/627 |
| 2009/0123249 | A1 | 5/2009 | Matunaga et al. | 410/66 |
| 2009/0178195 | A1 | 7/2009 | Zheng | 5/111 |

* cited by examiner

COLLAPSIBLE LITTER APPARATUS, SYSTEM AND METHOD

CROSS REFERENCE TO RELATED PATENTS

The present invention claims the benefit of priority of U.S. Provisional Application No. 61/121,224 filed on Dec. 10, 2008, the entire contents of which are incorporated herein by reference.

BACKGROUND OF THE INVENTION

The present invention relates generally to litter systems and devices for use in carrying patients or casualties, and, in particular, the invention relates to a collapsible litter device that employs a detachable bed.

In both the medical and military fields, there is a need for means to immobilize and transport patients and casualties. For example, in modern rescue operations, those tasked with rescuing are frequently required to move patients up and down stairs or over uneven terrain for long distances, and under extreme environmental conditions.

Numerous stretchers or litters have been proposed and made available for this purpose. Of the many different types of litters, collapsible litters are of particular interest based on their convenience and utility. The ability to collapse and fold litters into a compact package is advantageous for storing, handling and transporting litters that are not in use. Even more important than providing an easily collapsible litter, however, is to provide a litter that is sufficiently rigid and strong for all purposes. Accordingly, collapsible litters should not only be compact and lightweight for transporting purposes, but they must also be rigid and sturdy in the extended position.

While there exist various designs for collapsible litters or carriers, each of these prior designs is problematic. Traditional, collapsible litters tend to be cumbersome and difficult to maneuver. These litters do not allow for the angulated movement necessary to transport a patient up and down a stair case. Many traditional litters require the attachment of a mobility device to facilitate in the transport of the patient. These litters, however, still fail to provide adequate means to secure the litter in an evacuation platform, such as a helicopter or ambulance, while the mobility device is attached.

Some litters are easily collapsed, but experience mechanical or other problems when extended into a rigid structure for carrying a patient. Many collapsible litters fail to remain locked in an open or extended position. Other carriers are simply too cumbersome and difficult to transport or pack. Still others are constructed from materials that are too fragile or brittle for extreme or difficult conditions. The weight of prior litters is also a problem, especially in situations where the litters must be transported in a backpack over long distances and/or in extreme weather.

Additional complications can occur if the patient or casualty has to be efficiently thermally insulated as well as immobilized. Furthermore, many of the known stretchers are uncomfortable to the patient. Oftentimes, the patient will face additional risk or injury if moved multiple times from the initial location of the injury. However, most litters are generally only useful for moving a patient from one location to another. Ultimately, the patient must be removed from the litter and placed on a different bed, such as a hospital bed.

Prior litter systems have also exhibited problems when a patient or casualty is being transported from a place of contamination. These litters are not easily cleaned, and typically require that the patient or casualty be removed from the litter and that the litter be discarded.

Accordingly, there exists a need for a litter that is effective in any and all medical and military situations. The present invention addresses this need through a collapsible litter that is compact, lightweight, and yet rigid and sturdy in the extended position. Furthermore, the litter of the present invention can be folded and unfolded with the utmost of ease under the most adverse conditions.

SUMMARY OF THE INVENTION

The following presents a simplified summary of the invention in order to provide a basic understanding of some aspects of the invention. This summary is not an extensive overview of the invention. It is not intended to identify key or critical elements of the invention or to delineate the scope of the invention; its sole purpose is to present concepts of the invention in a simplified form as a prelude to the more detailed description that is subsequently presented.

According to its major aspects and briefly stated, the present invention includes a collapsible litter carrier apparatus, system and method. Generally, the litter apparatus includes a frame assembly having a plurality of hingedly connected, longitudinally adjacent sections that are foldable or collapsible, accordion-like, into a compact arrangement when the carrier is not in use or being stored. Releaseably attached to the frame assembly is a body-supporting bed or sheet. Additionally, the frame assembly is provided with a plurality of foldable handles that are hingedly connected to the outer corners of the extended frame.

The frame assembly can be conveniently extended and rigidly locked in an unfolded position for use. When extended to support a patient or casualty, the litter rigidly and safely locks into an unfolded position. Furthermore, the locking arrangement of the litter avoids accidental folding or collapse when a person is being supported by the litter. Only by purposeful release can the litter become folded or collapsed.

In particular, the frame assembly of the litter system includes a first side member and a second side member interconnected by one or more spreader members for maintaining the side members in a laterally spaced arrangement when the litter is an unfolded position. In an extended position, the spreader extends transversely in relation to the longitudinally extending side members. Each of the first and second side members includes a pair of spaced apart, substantially parallel beams or poles that form the side edges of the unfolded litter. In an extended position, the parallel poles are arranged in a vertical or upright position so that one pole is positioned on top of or over the second, corresponding pole from the pair.

In an exemplary embodiment, each of the frame poles is constructed from a plurality of pole members pivotally connected for moving between a folded configuration, wherein the pole members are generally stacked one upon the other, and an unfolded configuration, wherein the pole members are generally aligned end to end in a common or parallel plane to form each of the frame poles. Additionally, between each pair of poles are included a plurality of spaced apart cross beams that are hingedly connected to and span the pair of poles. The cross beams can be located at the juncture points between the plural pole members.

Additionally, the substantially parallel poles of the side members can converge at opposing, outermost ends of the side members. In one embodiment, one of the pair of longitudinal poles can be curved at each of its opposing ends so that the one, curved pole converges with the other, substantially straight pole at each end of the pole. In another embodiment, both poles of each pair of poles can be curved so as to converge at the ends of the poles. Alternatively, the poles do not converge, and each of the parallel beams of the side members is substantially straight when the litter is extended.

Resembling the structure of a ladder, each side member includes cavities defined by each pair of longitudinally extending poles and the cross beams. These cavities are dimensioned to receive the spreader members and handles when the litter is in a folded position. This feature of the present invention allows for the most compact, folded configuration of the litter to be achieved.

Another feature of the present invention includes the use of a "split-beam" or pair of poles as side members for the frame assembly. The use of a top and bottom beam or pole rather than a single pole alleviates the need for including additional support, such as through the use of support legs, when the litter is in use, extended and resting on a bottom support such as the ground. By providing a pair of beams, rather than a single beam, the overall strength and rigidity of the litter is greatly enhanced. Moreover, the overall weight of the frame can be decreased without sacrificing strength even if traditional construction material are used such as a metal alloy.

Although a number of different dimensions and features are contemplated, one embodiment of the spreader member connecting the first and second side members includes a first pair of converging cross bars coupled to a second pair of converging cross bars that are connected the converging ends through a coupling plate. Furthermore, the divergent ends of each pair of cross bars are hingedly connected to the first and second side members, respectively. In an unfolded configuration, the cross bars are arranged in a vertical or upright position transverse to the side members. Accordingly, one cross bar from each pair of cross bars is positioned on top of or over the second, corresponding cross bar from the pair. In one embodiment, the top cross bar of each pair of cross bars is hingedly connected to the top pole of each side member, while the bottom cross bar of each pair of cross bars is hingedly connected to the bottom pole of each side member when the litter is in an unfolded position. Additionally, the spreader member is lockable, and, optionally, it is lockable in a plurality of positions based on the need for space between the side members, as well as the preferred position of the spreader member for purposes of folding and unfolding the litter.

At each end of the side members is included a foldable handle. Preferably, these handles are hingedly connected to the frame assembly between the pair of pole members of the side members. Additionally, the handles are rotatable and lockable and, optionally, they are lockable in a plurality of positions based on the need of the handles, as well as the preferred position of the handles for purposes of folding and unfolding the litter.

The bed portion of the litter system includes a central bed section located between the side members of the frame assembly that extends in a longitudinal direction parallel to that of the side members when the litter is unfolded. The central bed portion includes a plurality of laterally extending panels or connecting members that are dimensioned to receive and wrap around the top, opposing frame poles of each of the first and second side members when the litter is unfolded. These panels can be releasable secured to the frame by any suitable means, including, but not limited to hook and loop fasteners, grommets, cords, and adhesive. Alternatively, the bed can further include one or more straps on the surface of the bed on which a patient or casualty rests. These straps can ensure that a patient is secured to the bed during transport. Additionally, the straps can be used to further secure the bed portion to the frame assembly.

Another feature of the present invention includes the use of a removable bed that can be secured to the frame to ensure that a patient or casualty remains supported and safe throughout the transported. Because the bed is removable, it can be easily cleaned or discarded if it is no longer suitable for use. Moreover, the side panels of the bed can be used as a gripping means by medical personnel to safely lift and remove the patient from the frame assembly and thereafter place the patient on another bed, such as a hospital bed or gurney. This feature reduces the risk to the patient associated with transfers from multiple surfaces and places after an injury occurs.

Other features and their advantages will be readily apparent to those skilled in decorative arts, techniques and equipment from a careful reading of the Detailed Description of Preferred Embodiments, accompanied by the following drawings.

DETAILED DESCRIPTION OF THE PREFERRED EMBODIMENT

Figure 2:
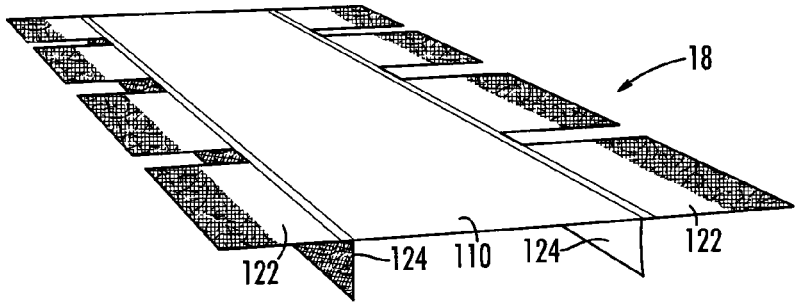
FIG. 2 is a perspective view of a bed portion of a collapsible litter system and apparatus according to an embodiment of the present invention.
Figure 1:
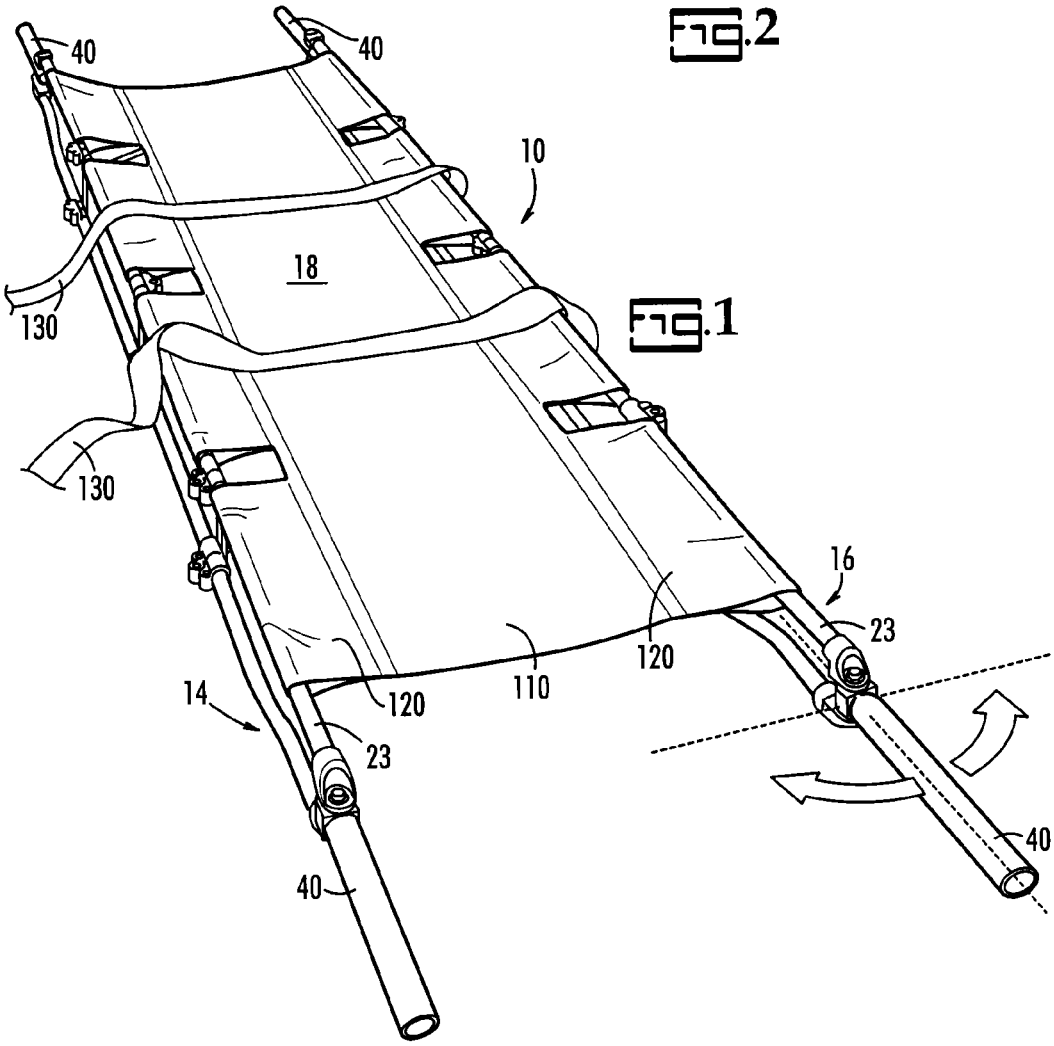
FIG. 1 is a perspective view of a collapsible litter system and apparatus according to an embodiment of the present invention.

The present invention includes a collapsible litter system and apparatus, and method for folding and unfolding the collapsible litter. As shown in FIGS. 1-3B, the litter system 10 includes frame assembly 12 having a first side member 14 and a second side member 16 interconnected by one or more spreader members 20 for maintaining the side members 14, 16 in a laterally spaced arrangement when the litter 10 is an unfolded position. The litter system 10 further includes a bed 18 that is releaseably attached to the frame assembly 12, as well as a plurality of handles 40 that can be folded in numerous directions for convenient use, storage or collapsing of the litter 10.

When the litter 10, and thereby the frame assembly 12, is an unfolded position, the spreader member 20 extends in a transverse direction that is substantially orthogonal to the side members 14, 16, which extend in a longitudinal direction. The first and second side members 14, 16 include a first and second pair of spaced apart, substantially parallel beams or poles, 22, 24, respectively, that extend longitudinally to form the side edges of the unfolded litter 10. In an extended position, each pair of parallel poles 22, 24 are arranged in a vertical or upright position so that one pole 23 of each pair, is positioned on top of or over the second, corresponding pole 25 from each pair.

In an exemplary embodiment, each of the frame poles is constructed from a plurality of pole arms pivotally connected for moving between a folded configuration, wherein the pole arms are generally stacked one upon the other, and an unfolded configuration, wherein the pole arms are generally aligned end to end in a common or parallel plane to form each of the frame poles.

In one embodiment, the top pole of the first pair of poles 22 is constructed from a plurality of pole arms 27*a-d* that are pivotally connected and coupled to the frame assembly 12. The bottom pole of the first pair of poles 22 is also constructed from a plurality of pole arms 27*e-h* that are pivotally connected and coupled to the frame assembly 12. Similarly, the top pole of the second pair of poles 24 is constructed from a plurality of pole arms 29*a-d* that are pivotally connected and coupled to the frame assembly 12. The bottom pole of the second pair of poles 24 is also constructed from a plurality of pole arms 29*e-h* that are pivotally connected and coupled to the frame assembly 12.

Additionally, between each pair of poles are included a plurality of spaced apart cross beams 62 that are hingedly connected to and span the pair of poles 22, 24. In particular, the cross beams 62 extend about perpendicularly from the bottom pole 25 to the top pole 27 of each pair of poles 22, 24. The cross beams 62 are located at juncture points 64 between the plurality of pole arms, 27*a-d*, 27*e-h*, 29*a-d*, and 29*e-h*, respectively. For pivoting purposes, each juncture point 64 includes one or more hinges 200 that are coupled to the frame assembly 12, and which are shown in more detail in FIGS. 6-8.

Figure 3A:
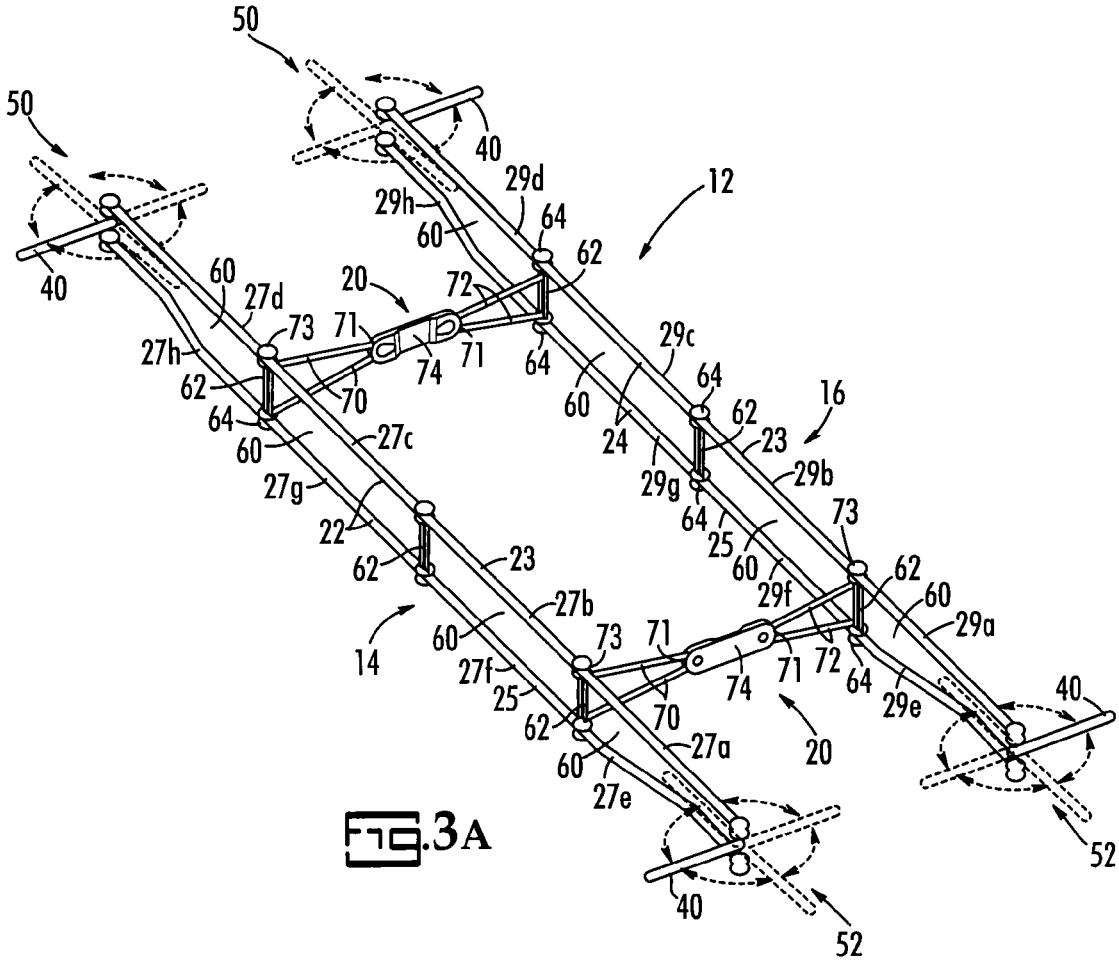
FIG. 3A is a perspective view of a frame assembly of a collapsible litter system and apparatus according to an embodiment of the present invention.
Figure 3B:
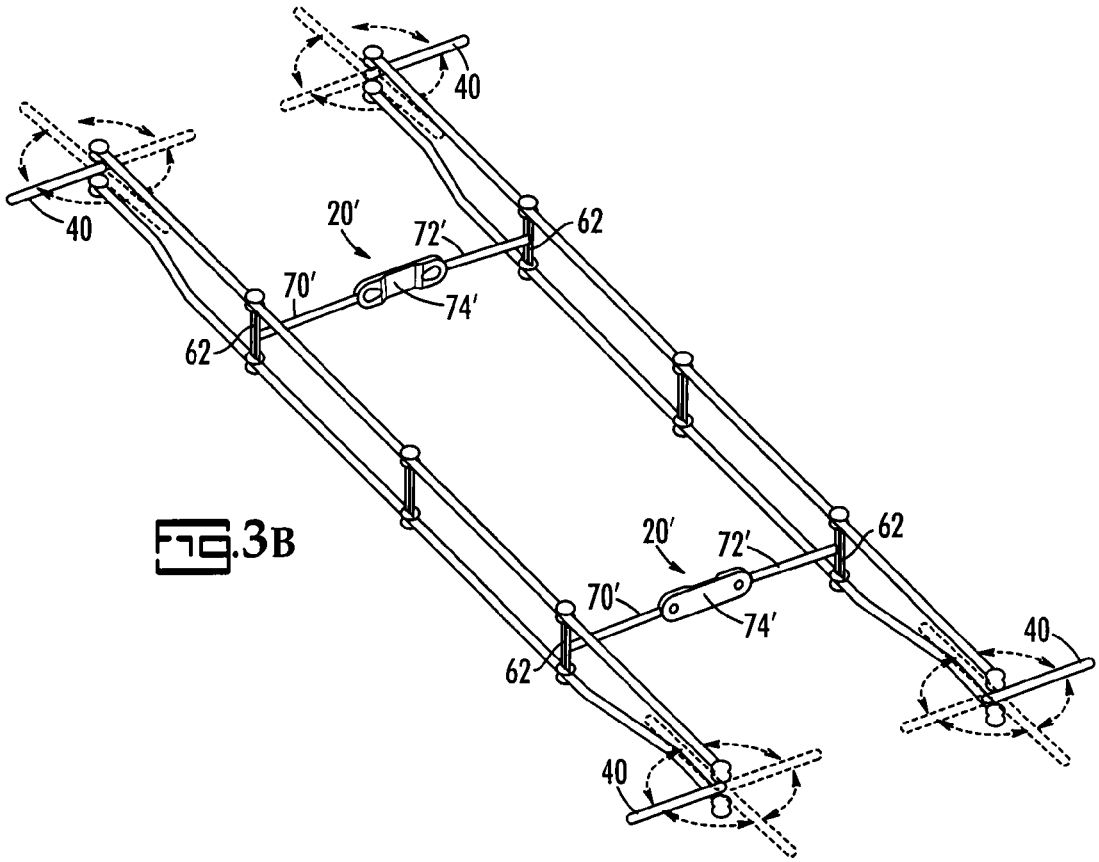
FIG. 3B is a perspective view of a frame assembly of a collapsible litter and apparatus according to an embodiment of the present invention.

Additionally, in one embodiment, the substantially parallel poles 22, 24 of the side members 14, 16 include curved members so that the poles appear to converge at opposing, outermost ends, including ends 50 and 52, of the side members. For example, as shown in FIGS. 3A-B, bottom poles 25 of each pair of poles 22, 24, can be curved at each of its opposing ends, 50, 52, so that the curved pole 25 approaches a convergence point with the other, substantially straight pole 23. In particular, pole arms 27*e*, 27*h*, 29*e*, and 29*h*, can each be curved and positioned so as to approach a convergence point with pole arms 27*a*, 27*d*, 29*a*, and 29*d*, respectively. In another embodiment, not shown, each pole of each pair of poles 22, 24 can be curved so as to converge at the ends of the poles. Alternatively, the poles do not converge, and each of the poles of the side members 14, 16 is substantially straight when the litter 10 is extended.

Resembling the structure of a ladder, each side member 14, 16, includes cavities 60 defined by each pair of poles 22, 24 and the cross beams 62. These cavities 60 are dimensioned to receive the spreader member 20 and handles 40 when the litter 10 is being collapsed and when the litter 10 is in a folded position. This feature of the present invention allows for the most compact, folded configuration of the litter 10 to be achieved.

Another feature of the present invention includes the use of a "split-beam" or pair of poles 22, 24 as side members for the frame assembly. The use of a top and bottom beam or pole 25, 27, rather than a single pole alleviates the need for including additional support, such as through the use of support legs, when the litter 10 is in use, extended and resting on a bottom support such as the ground. By providing a pair of beams 22, 24, rather than a single beam, the overall strength and rigidity of the litter 10 is greatly enhanced. Moreover, the overall weight of the frame assembly 12 can be decreased without sacrificing strength even if traditional construction material are used such as a metal alloy.

Although a number of different dimensions and features are contemplated, one embodiment of the spreader member 20 connecting the first and second side members 14, 16, includes a first pair of converging cross bars 70 coupled to a second pair of converging cross bars 72 that are connected at converging ends 71 through a coupling plate 74. Furthermore, the first and second pair of cross bars 70, 72 are pivotally connected to the side members 14, 16 at divergent ends 73, respectively. In an unfolded configuration, the cross bars 70, 72 are arranged in a vertical or upright position and extend transversely in relation to the side members 14, 15. Accordingly, one cross bar from each pair of cross bars is positioned on top of or over the second, corresponding cross bar from the pair.

In one embodiment, the frame assembly 12 includes two spreader members 20, wherein the top cross bar of each pair of cross bars 70, 72 of each member 20 is hingedly connected to the top pole 23 of each side member, 14, 16, while the bottom cross bar of each pair of cross bars 70, 72 is hingedly connected to the bottom pole 25 of each side member 14, 16, when the litter 10 is in an unfolded position.

In an alternative embodiment, such as shown in FIG. 3B, the spreader member 20' includes a first cross bar 70' coupled to a second cross bar 72' through a coupling plate 74'. In particular, the cross bars 70', 72' extend transversely in relation to the side members 14, 16, and are connected to opposing cross beams 62 of the first and second pair of poles 22, 24. In this embodiment, two spreader members 20', are connected to the frame assembly 12.

Additionally, the spreader member 20 or 20' is preferably lockable, and, optionally, it is lockable in a plurality of positions based on the need for space between the side members, 14, 16 as well as the preferred position of the spreader member for purposes of folding and unfolding the litter. Preferably, the spreader member 20 or 21' is only unlocked by purposeful release, such as through a detent means.

Although numerous alternative locking means for the spreader member 20 are contemplated for use with the present invention, one embodiment can include a ratcheting mechanism that is generally represented in FIGS. 13-16. In particular, each pair of converging cross bars 70, 72 can be rotatably lockable at a plurality of increments, such as evenly spaced increments. To engage and rotate the cross bars 70, 72, a detent 78 can be activated, such as by pressing down. This detent 78 releases the cross bars 70, 72, from a locked position so that the cross bars 70, 72 move and rotate freely until the detent 78 is released and the cross bars 70, 72 are locked into place at a different increment.

At each end of the side members 14, 16, is included a foldable handle 40. Preferably, these handles 40 are pivotally connected to the frame assembly 12 between each pair of poles 22, 24, of the side members 14, 16. Generally, each handle 40 can be fully rotatable about a vertical axis that is substantially orthogonal to the longitudinal axis of the side members 14, 16, when the litter 10 is in an unfolded position. In addition to being rotatable, the handles 40 are lockable and, optionally, they are lockable in a plurality of positions based on the need of the handles, as well as the preferred position of the handles 40 for purposes of folding and unfolding the litter.

Although numerous alternative locking means for the handle 40 are contemplated for use with the present invention, one embodiment is generally represented in FIGS. 9-12. In this embodiment, handle 40 is pivotally connected to an axle 80 that is connected to top and bottom poles 23, 25 through a first and second coupling member 82, 84, respectively. Additionally, axle 80 includes a spring 88 that forces the handle 40 in the direction of a detent 90, which is connected to first coupling member 82 of the top pole 23. This detent 90 corresponds to a plurality of notches 92 formed either integral with the handle 40 or in a coupling means connecting the handle 40 to the axle 80. In use, the handle 40 remains in a locked position until a positive force is applied to the spring 88 so as to compress it sufficiently to release the detent 90 from the notch 92. The handle 40 can then move and rotate freely until the spring 88 is released and the detent 90 engages a notch 92 at a different increment. The handle can be rotatable at evenly spaced increments, including increments that are spaced apart at about 90°.

Figure 9:
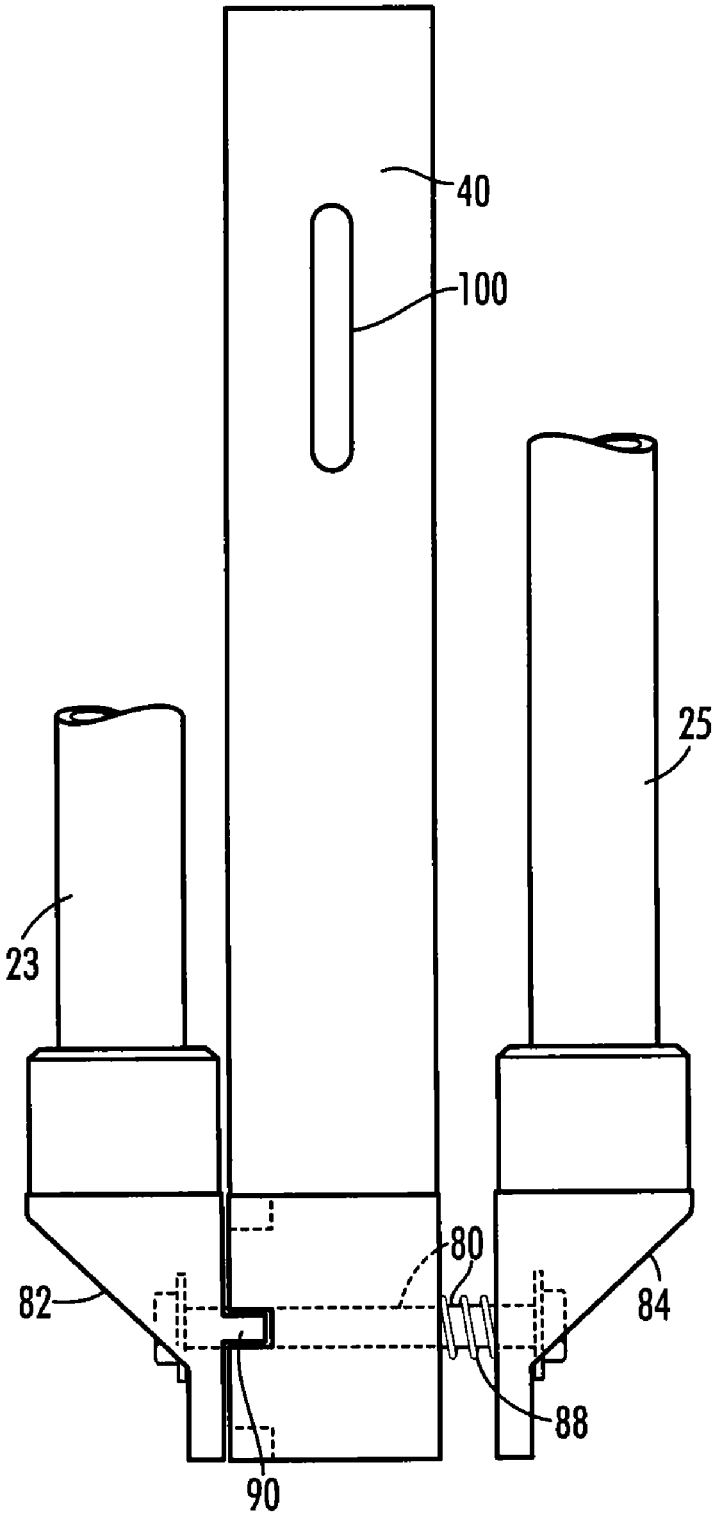
FIG. 9 is a side, perspective view of a handle portion of a collapsible litter system and apparatus according to an embodiment of the present invention.
Figure 10:
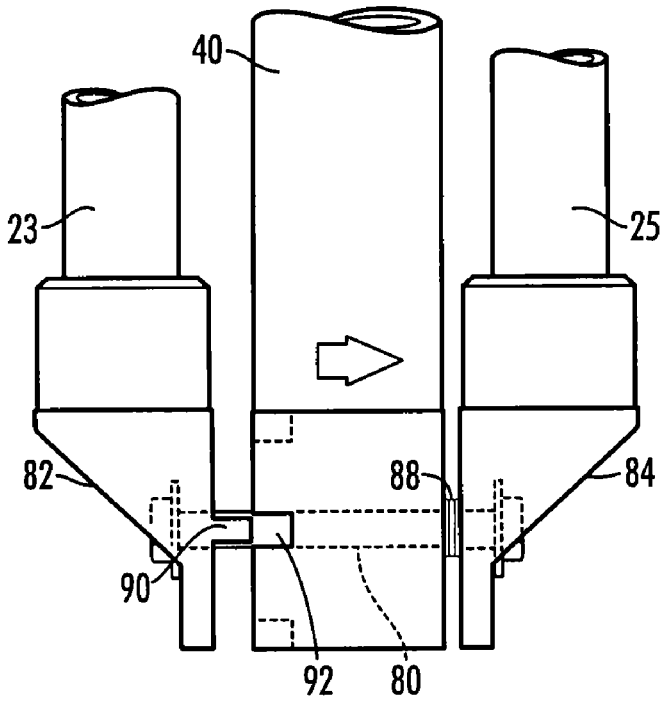
FIG. 10 is a side, perspective view of a handle portion of a collapsible litter system and apparatus according to an embodiment of the present invention.
Figure 11:
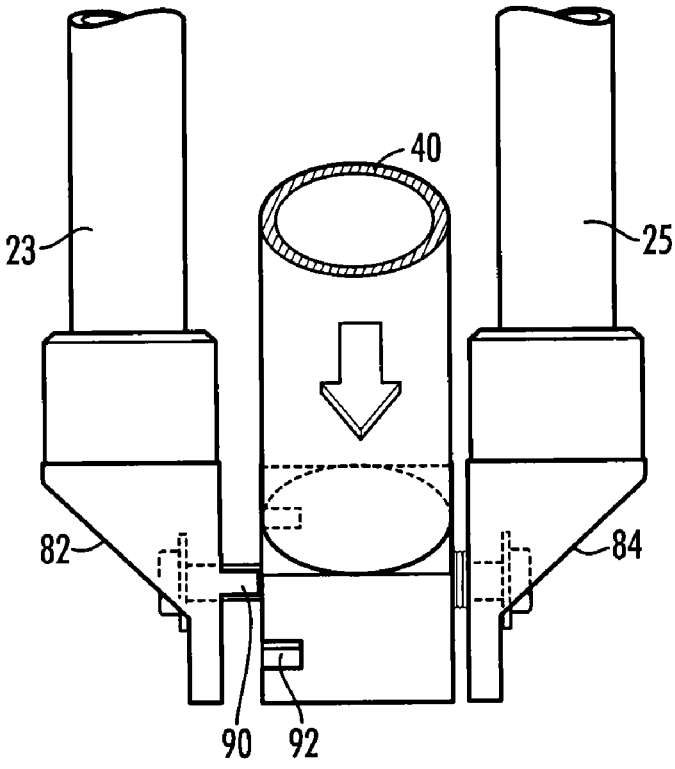
FIG. 11 is a side, perspective view of a handle portion of a collapsible litter system and apparatus according to an embodiment of the present invention.
Figure 12:
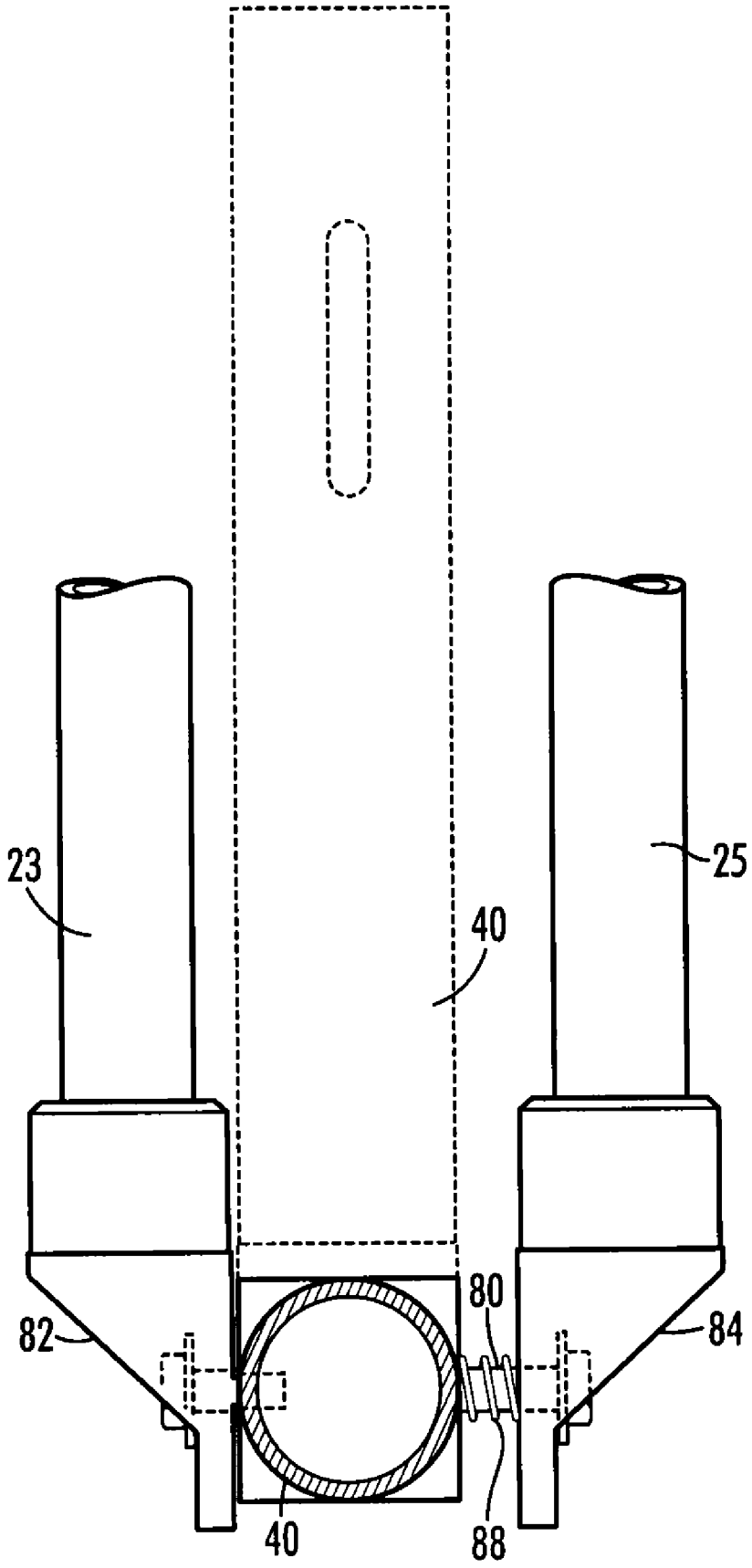
FIG. 12 is a side, perspective view of a handle portion of a collapsible litter system and apparatus according to an embodiment of the present invention.
Figure 13:
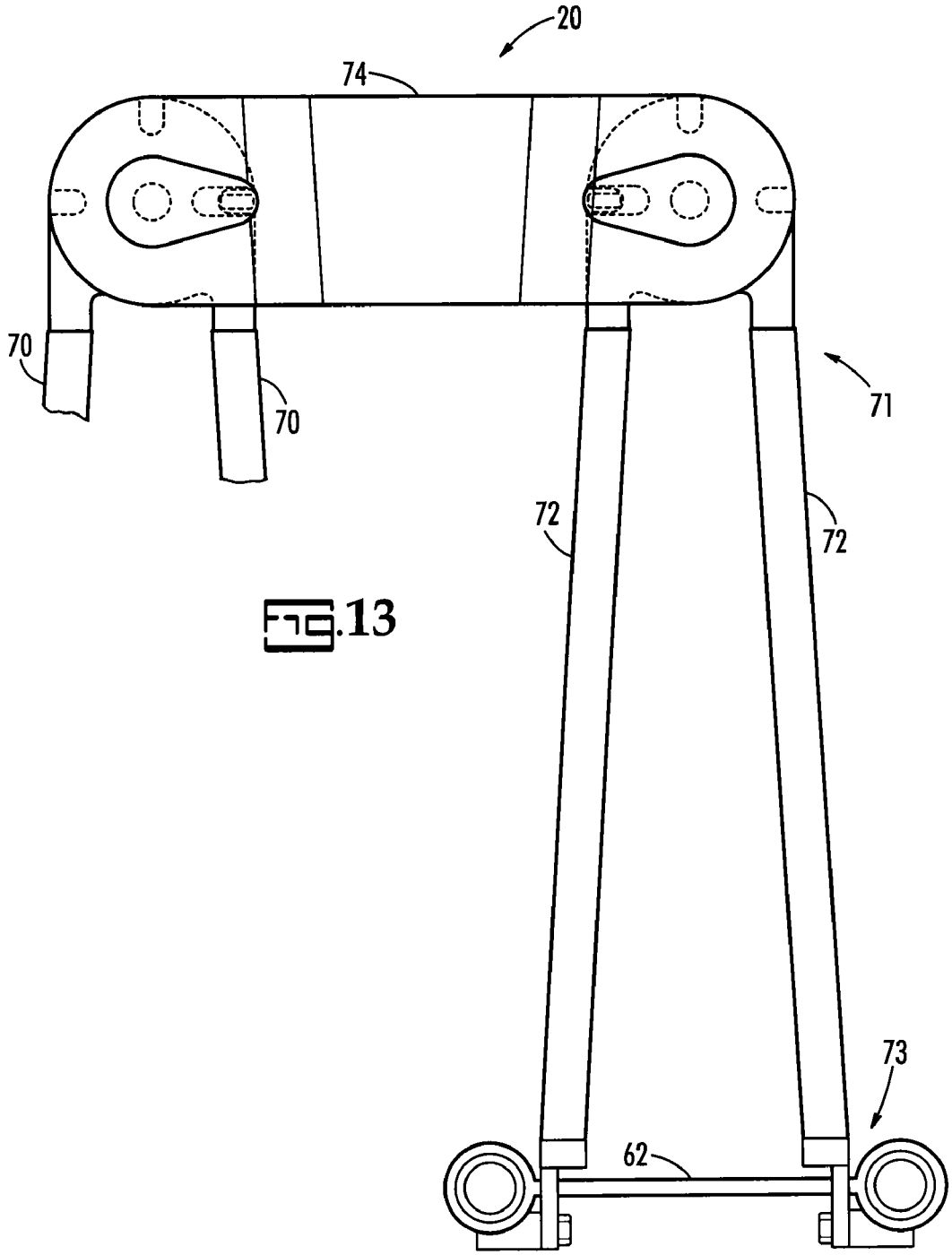
FIG. 13 is a front, perspective view of a spreader member of a collapsible litter system and apparatus according to an embodiment of the present invention.
Figure 14:
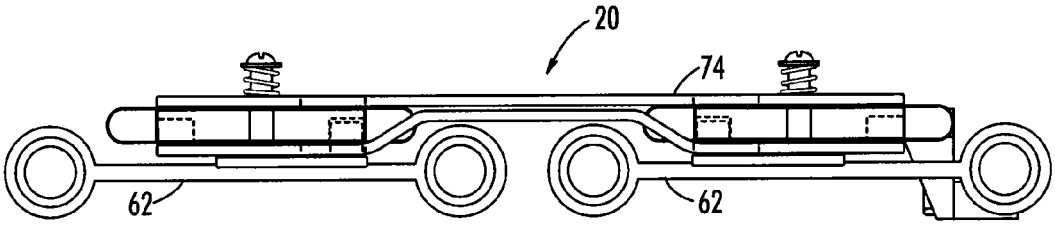
FIG. 14 is a top, perspective view of a spreader member of a collapsible litter system and apparatus according to an embodiment of the present invention.
Figure 15:
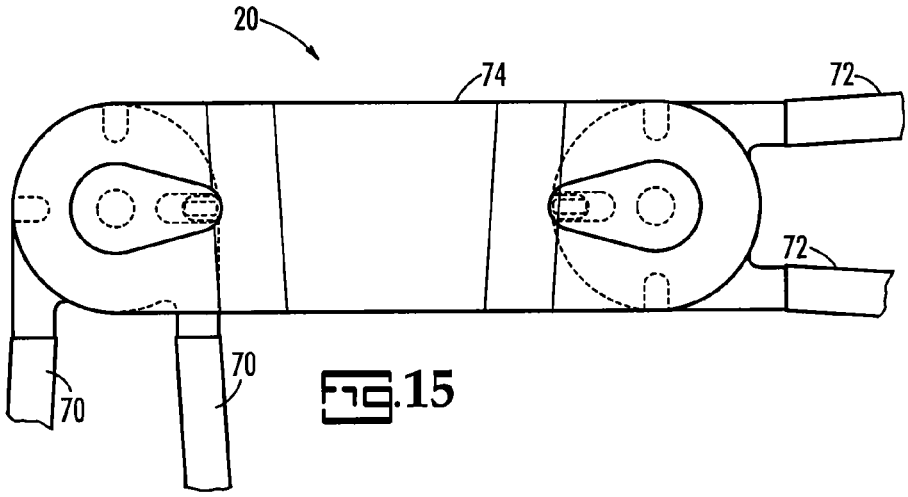
FIG. 15 is a front, perspective view of a spreader member of a collapsible litter system and apparatus according to an embodiment of the present invention.
Figure 16:
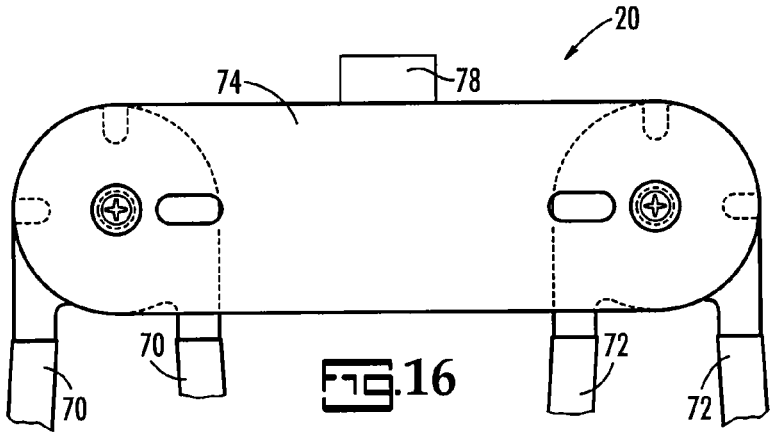
FIG. 16 is a front, perspective view of a spreader member of a collapsible litter system and apparatus according to an embodiment of the present invention.

Also shown in FIG. 9 is an alternative embodiment for the handle 40, which includes a slot 100. This slot 100 can be used in various applications, and especially during the transport of a patient. For example, a strap or cord can be threaded through this slot 100, which can be included in each of the handles, so as to create an additional carrying or transporting means. When threaded through two handles 40 at one end of the litter 10, medical personnel can form a carrying strap that can be worn by the personnel in an effort to free the hands of the personnel during the transport. In situations, such as combat situations, medical personnel ideally require the use of their hands, such as to carry defense weapons. Additionally, there may be situations in which only one medical personnel is able to carry the patient. The use of a carrying strap can facilitate the transport of a patient in these and other situations.

The bed portion 18 of the litter system 10 includes a central bed section 110 located between the side members 14, 16, of the frame assembly 12 that extends in a longitudinal direction parallel to that of the side members 14, 16, when the litter 10 is unfolded. The central bed portion 110 includes a plurality of laterally extending panels 120 or connecting members that are dimensioned to receive and wrap around the top, opposing frame poles 23 of each of the first and second side members 14, 16 when the litter 10 is unfolded. These panels 120 can be releasable secured to the frame by any suitable means, including, but not limited to hook and loop fasteners, grommets, cords, and adhesive. In one embodiment, shown in FIG. 2, each side panel 120 can include a first and second attachment member 122, 124. Along the first attachment member 122, for example, can be include a series of hooks that correspond to a series of loops located on the second attachment member 124.

Alternatively, the bed can further include one or more straps 130 on the surface of the bed on which a patient or casualty rests. These straps 130 can ensure that a patient is secured to the bed during transport. Additionally, the straps 130 can be used to further secure the bed portion to the frame assembly.

Another feature of the present invention includes the use of a removable bed 18 that can be secured to the frame 12 to ensure that a patient or casualty remains supported and safe throughout the transported. Because the bed 18 is removable, it can be easily cleaned or discarded if it is no longer suitable for use. Moreover, the side panels 120 of the bed 18 can be used as a gripping means by medical personnel to safely lift and remove the patient from the frame assembly and thereafter place the patient on another bed, such as a hospital bed or gurney. This feature reduces the risk to the patient associated with transfers from multiple surfaces and places after an injury occurs.

A method of collapsing the litter 10 previously described is shown in FIGS. 4-8. For convenience and illustration purposes, the bed portion 18 of the litter system 10 is removed so that the various pivoting motions and frame orientations can be better understood. In a completely extended configuration, the collapse of the litter 10 can begin by positively releasing the lock on any and all spreader members 20. Depending on the orientation of the litter 10, the spreader member can be moved up or down with relation to the side members 14, 16. Preferably, the frame assembly 12 can be flipped in orientation so that the top poles 23 of the side members rest on the ground or a bottom support. In this orientation, once the lock of each spreader member 20 is released, the spreader member 20 coupling plate 74 is moved in a vertical direction parallel to a vertical axis B and about perpendicular to a longitudinal axis A, so that the cross bars 70, 72 of the spreader member 20 can rotate about the coupling plate 74 and longitudinal axis A to move beneath the plate 74 and towards each other.

Figure 4:
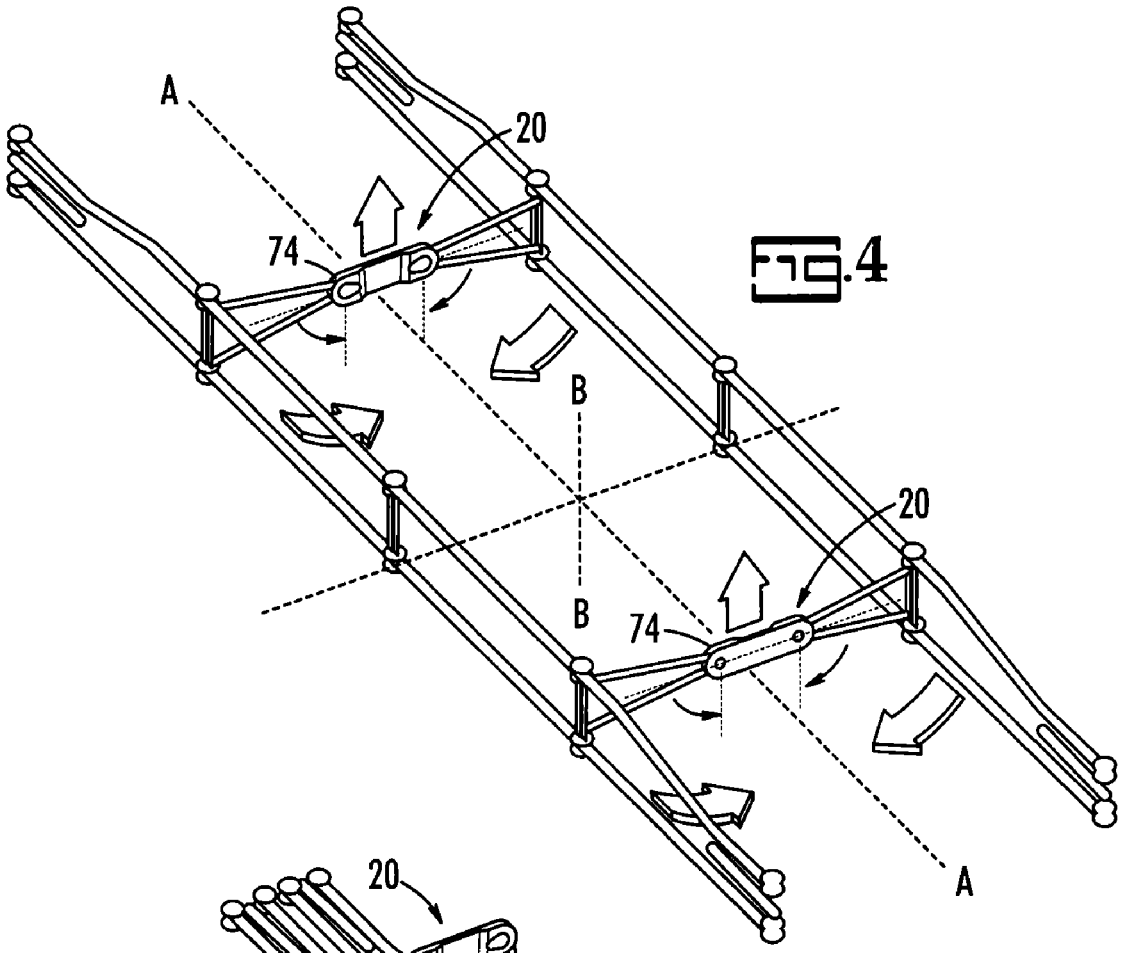
FIG. 4 is a perspective view of a frame assembly of a collapsible litter system and apparatus according to an embodiment of the present invention.
Figure 5:
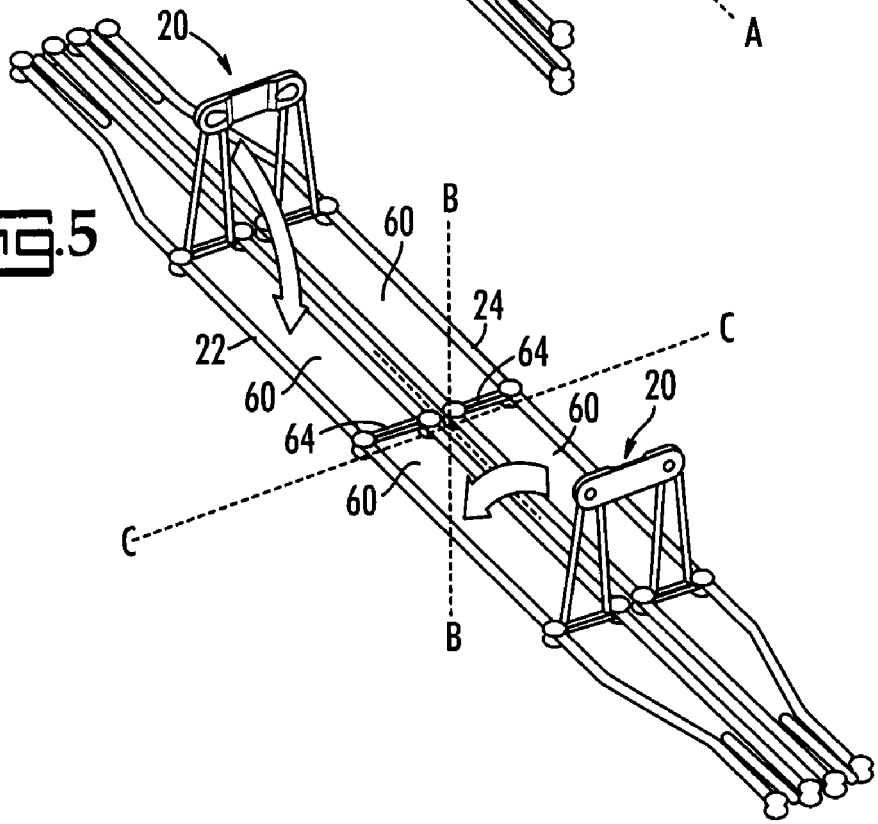
FIG. 5 is a perspective view of a frame assembly of a collapsible litter system and apparatus according to an embodiment of the present invention.

Simultaneous to the movement of the cross bars 70, 72, the side members 14, 16 are also rotated about longitudinal axis A and moved beneath the plate 74, as the side members 14, 16 are coupled to the cross bars 70, 72. As illustrated in FIG. 4-5, the side members 14, 16 begin in a vertical, upright position, in separate planes parallel to the vertical axis B, when the litter 10 is extended. Thereafter, the movement of the spreader 20 in a vertical direction causes the side members 14, 16, to rotate about longitudinal axis A, and to end in a co-planar position, adjacent to each other, wherein each spreader 20 extends about perpendicularly from the horizontal plane defined by the side members 14, 16.

Once each spreader member 20 is in a fully upright position, shown in FIG. 5, the spreader member 20 is rotated about a transverse axis C moved down towards the cavities 60 formed by the parallel poles, 22, 24 and the cross beams 64. Preferably, the cavities 60 are dimensioned to receive each spreader member 20 so that the spreader member 20 is co-planar and flush with the side members 14, 16. At any time during the collapsing of the litter 10, handles 40 can be rotated into the cavities 60, respectively, so that the handle are also co-planar and flush with the side members 14, 16.

Figure 6:
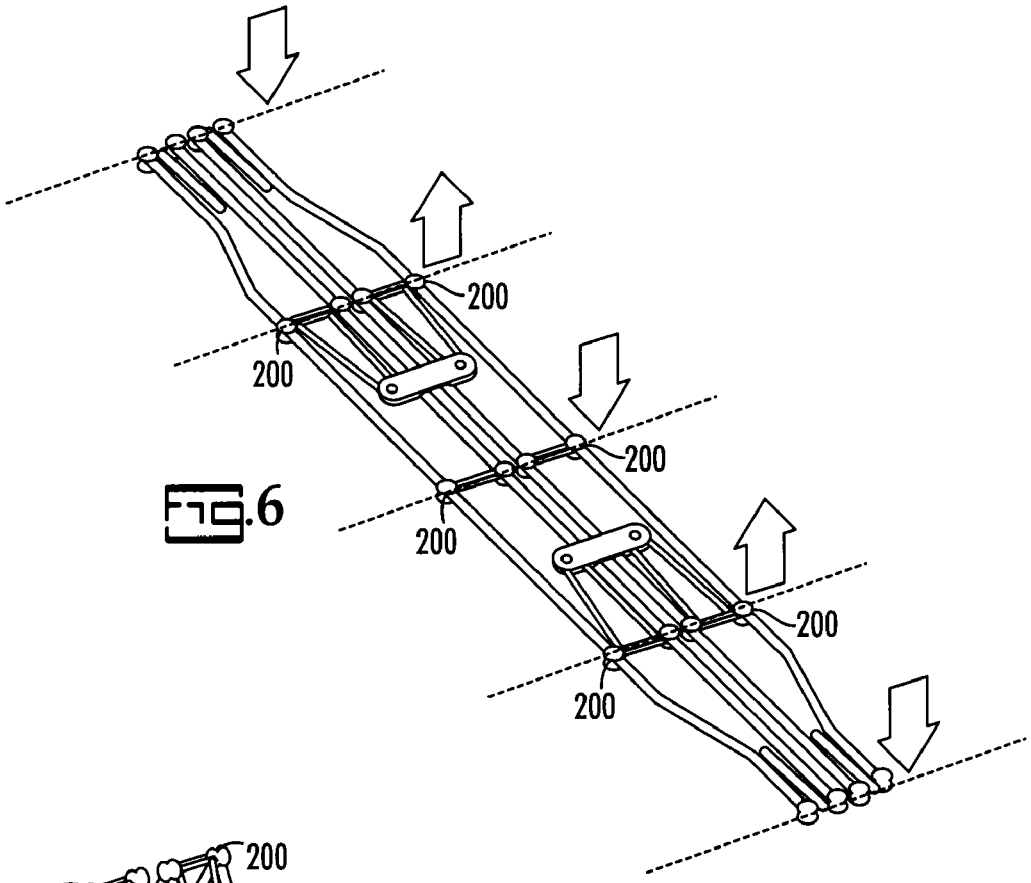
FIG. 6 is a perspective view of a frame assembly of a collapsible litter system and apparatus according to an embodiment of the present invention.
Figure 7:
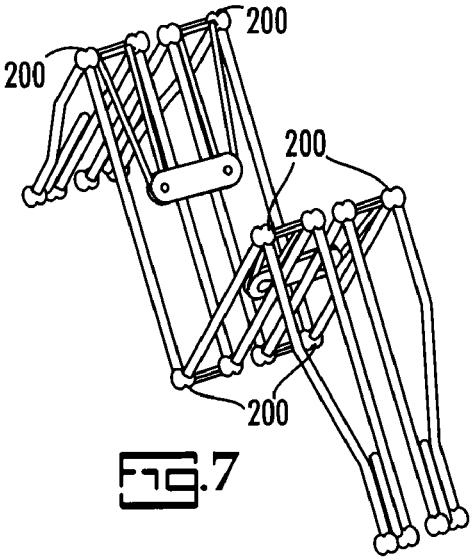
FIG. 7 is a perspective view of a frame assembly of a collapsible litter system and apparatus according to an embodiment of the present invention.
Figure 8:
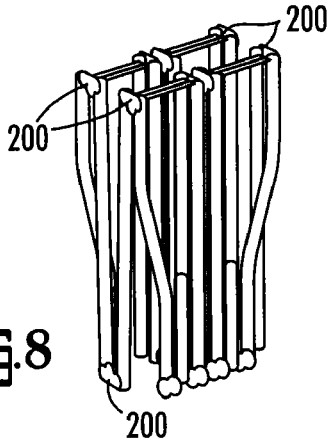
FIG. 8 is a perspective view of a frame assembly of a collapsible litter system and apparatus according to an embodiment of the present invention.

Once the frame assembly 12 is folded so that it is completely flat, with the side members 14, 16 in an adjacent, co-planar relation, and the handles 40 and spreader members 20 are contained within the cavities 60. The accordion-like folding can begin, as shown in FIGS. 6-8. By folding the frame assembly 12 into the flat configuration shown in FIG. 6, the hinges 20 located at juncture points 64 can be aligned for pivoting purposes. Referring now to FIGS. 7-8, when the hinges 200 are in lateral alignment parallel to transverse axis C, the pole arms can be pivoted to draw them together to the folded configuration, resembling a compressed W shape. This compact structure can thereafter be placed into a carrying means, such as a back pack for convenient storage and transport.

It should be noted that each separate component forming the embodiments of the litter 10 previously described are not specifically identified by a reference numeral. Most notably, the pole arms, handles, spreader member, cross bars, coupling plates and coupling members are hingedly linked. However, the particular features of the hinges 200 are not fully described, but are shown in the Figures. Any suitable hinge means is contemplated for use in connection with the various features and components of the litter system and apparatus 10. Similarly, although certain exemplary embodiments of locking mechanisms are shown and described, it should be understood that these are merely examples to illustrate a suitable construction for the present invention. Many substitutions and alternative embodiments are contemplated.

Additionally, various materials can be used to construct the frame assembly 12, as well as the bed portion 18. For example, the frame assembly can be made of an aluminum alloy or other metal alloy. The frame 12 can also be constructed from a carbon fiber composite, as well as a plastic material or composite. The bed portion 18 can made from any suitable, sturdy material, including woven, non-woven, or knitted fabric made of natural or synthetic materials.

Those skilled in the art of litter systems and devices arts appreciate from the foregoing description of preferred embodiments that substitutions and modification can be made without departing from the spirit and scope of the invention which is defined by the appended claims.

What is claimed is:

1. An apparatus, comprising:

a frame assembly having a first side member coupled to a second side member by a spreader member, wherein said first side member includes a first pair of longitudinally extending poles, wherein said second side member includes a second pair of longitudinally extending poles, wherein said first pair of longitudinally extending poles are connected by a first plurality of cross beams, wherein said second pair of longitudinally extending poles are connected by a second plurality of cross beams, wherein said first and second plurality of cross beams and said first and second pairs of longitudinally extending poles define a plurality of cavities, respectively, and wherein said frame assembly includes a plurality of rotatable handles pivotally connected to the ends of said first side member and said second side member.

2. The apparatus as recited in claim 1, wherein said first pair of longitudinally extending poles and said second pair of longitudinally extending poles each include a top pole and a bottom pole.

3. The apparatus as recited in claim 2, further comprising a bed releaseably connected to said top pole of said first and second pair of longitudinally extending poles.

4. The apparatus as recited in claim 1, wherein said plurality of handles includes four handles pivotally connected to each end of said first and second side members, respectively.

5. The apparatus as recited in claim 4, wherein said four handles are each lockable in a plurality of directions.

6. The apparatus as recited in claim 4, wherein at least two of said four handles includes a slot.

7. The apparatus as recited in claim 1, wherein said spreader member is two spreader members, and wherein each of said two spreader members is lockable.

8. The apparatus as recited in claim 7, wherein each of said two spreader members includes at least a first cross bar and a second cross bar that is pivotally connected to a central coupling plate.

9. The apparatus as recited in claim 1, wherein said first and second pairs of longitudinally extending poles each includes a top pole having a plurality of top pole arms that are pivotally connected, and wherein said first and second pairs of longitudinally extending poles each includes a bottom pole having a plurality of bottom pole arms that are pivotally connected.

10. The apparatus as recited in claim 1, wherein the ends of said first and second pair of longitudinally extending poles converge.

11. A system, comprising:

a frame assembly having a first side member coupled to a second side member by a spreader member, wherein said first side member includes a first pair of longitudinally extending poles, wherein said second side member includes a second pair of longitudinally extending poles, wherein said first pair of longitudinally extending poles are connected by a first plurality of cross beams, wherein said second pair of longitudinally extending poles are connected by a second plurality of cross beams, wherein said first and second plurality of cross beams and said first and second pairs of longitudinally extending poles define a plurality of cavities, respectively, and wherein said frame assembly includes a plurality of rotatable handles pivotally connected to the ends of said first side member and said second side members; and a bed releaseably connected to said frame assembly.

12. The system as recited in claim 11, wherein said first and second pairs of longitudinally extending poles each includes a top pole having a plurality of top pole arms that are pivotally connected, and wherein said first and second pairs of longitudinally extending poles each includes a bottom pole having a plurality of bottom pole arms that are pivotally connected.

13. The system as recited in claim 12, wherein said bed includes a central portion connected to a plurality of laterally extending panels, wherein each of said plurality of laterally extending panels is dimensioned to receive said top pole of said first and second pairs of longitudinally extending poles.

14. The system as recited in claim 13, wherein each of said plurality of laterally extending panels includes a first attachment member that corresponds to a second attachment member.

15. The system as recited in claim 14, wherein said first attachment member includes a series of hooks, wherein said second attachment member includes a series of loops, and wherein said hooks are dimensioned to releaseably engage said loops.

16. The system as recited in claim 11, wherein said plurality of handles includes four handles pivotally connected to each end of said first and second side members between said first and second pair of longitudinally extending poles, respectively, and wherein said four handles are lockable at a plurality increments.

17. The system as recited in claim 11, wherein said spreader member is two spreader members, wherein each of said two spreader members is lockable, and wherein each of said two spreader members includes at least a first cross bar and a second cross bar that is pivotally connected to a coupling plate.

18. The system as recited in claim 11, wherein the ends of said first and second pair of longitudinally extending poles converge.

19. The system as recited in claim 11, wherein said plurality of cavities are dimensioned to receive said spreader member and said plurality of handles.

20. A method, comprising the steps of:

providing an unfolded litter system, comprising a frame assembly having a first side member coupled to a second side member by a locked spreader member, wherein said first side member includes a first pair of longitudinally extending poles, wherein said second side member includes a second pair of longitudinally extending poles, wherein said first and second pairs of longitudinally extending poles each includes a top pole having a plurality of top pole arms that are pivotally connected by a plurality of top hinges, and wherein said first and second pairs of longitudinally extending poles each includes a bottom pole having a plurality of bottom pole arms that are pivotally connected by a plurality of bottom hinges, wherein said first pair of longitudinally extending poles are connected by a first plurality of cross beams, wherein said second pair of longitudinally extending poles are connected by a second plurality of cross beams, wherein said first and second plurality of cross beams and said first and second pairs of longitudinally extending poles define a plurality of cavities, respectively, and wherein said frame assembly includes a plurality of rotatable handles pivotally connected to the ends of said first side member and said second side members; and a bed releaseably connected to said frame assembly; and folding said unfolded litter system, comprising the steps of:

unlocking said locked spreader member;

moving said unlocked spreader to an upright position, while simultaneously moving said first and second side members to a co-planar, adjacent position beneath said upright spreader, wherein said upright spreader lies in a plane that is about perpendicular to plane defined by said adjacent first and second side members;

folding said locked spreader member into one of said plurality of cavities;

folding said plurality of handles into others of said plurality of cavities;

aligning said top and bottom hinges; and folding said top and bottom pole arms in an accordion-like fashion so that said frame assembly is in a fully folded, compact configuration.

* * * * *